US009523941B2

(12) United States Patent
Koizumi

(10) Patent No.: US 9,523,941 B2
(45) Date of Patent: Dec. 20, 2016

(54) IMAGE FORMING APPARATUS AND DEVELOPING AGENT DISCHARGE CONTROL METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Susumu Koizumi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/712,257

(22) Filed: May 14, 2015

(65) Prior Publication Data

US 2016/0334735 A1 Nov. 17, 2016

(51) Int. Cl.
*G03G 15/08* (2006.01)

(52) U.S. Cl.
CPC ..... *G03G 15/0844* (2013.01); *G03G 15/0889* (2013.01)

(58) Field of Classification Search
CPC ..... G03G 2215/0836; G03G 2215/0838
See application file for complete search history.

(56) References Cited

U.S. PATENT DOCUMENTS 7,206,538 B2 * 4/2007 Kumar ..... G03G 15/0844 399/257
7,729,641 B2 * 6/2010 Suzuki ..... G03G 15/0808 399/119
8,385,754 B2 * 2/2013 Hirobe ..... G03G 15/0893 399/119
2005/0214001 A1 * 9/2005 Sakamaki ..... G03G 15/0822 399/27
2006/0029405 A1 * 2/2006 Tanaka ..... G03G 15/556 399/27
2011/0026959 A1 * 2/2011 Itaya ..... G03G 15/0849 399/53
2011/0052220 A1 * 3/2011 Nose ..... G03G 15/0844 399/27
2011/0052221 A1 3/2011 Hirobe et al.
2011/0064435 A1 * 3/2011 Takahashi ..... G03G 15/0877 399/58
2011/0229209 A1 9/2011 Takaya et al.
(Continued)

*Primary Examiner* — David Gray
*Assistant Examiner* — Carla Therrien
(74) *Attorney, Agent, or Firm* — Amin, Turocy & Watson LLP; Gregory Turocy

(57) ABSTRACT

An image forming apparatus comprising a developing agent storage section including a discharge port for discharging the developing agent; a developing agent mixer configured inside the developing agent storage section to stir the developing agent and move the developing agent towards the discharge port; a motor which rotates at least the developing agent mixer; a motor control section which rotates the motor at either a first speed at which the developing agent is not discharged from the discharge port or a second speed higher than the first speed to discharge the developing agent from the discharge port; and a device control section which controls the motor control section to switch the rotation speed of the motor to the second speed at a timing different from the timing when the developing roller develops the electrostatic latent image.

6 Claims, 11 Drawing Sheets

(56) References Cited

U.S. PATENT DOCUMENTS

| | | | | |
|---|---|---|---|---|
| 2015/0153679 | A1* | 6/2015 | Onuki ..... | G03G 15/0891 399/53 |
| 2015/0168873 | A1* | 6/2015 | Hamakawa ..... | G03G 15/0889 399/53 |

* cited by examiner

IMAGE FORMING APPARATUS AND DEVELOPING AGENT DISCHARGE CONTROL METHOD

FIELD

Embodiments described herein relate generally to an image forming apparatus and a developing agent discharge control method.

BACKGROUND

There is an image forming apparatus which forms a visible image (toner image) on an image carrier. The image forming apparatus is provided with a photoconductor and a developing device. The image forming apparatus forms an electrostatic latent image on the photoconductor based on image information. The developing device develops the electrostatic latent image with toner. A two-component developing type developing device is provided with developing agent obtained by mixing toner and carrier, a developing roller and a developing agent mixer. The developing roller contacts the developing agent with the photoconductor. The developing agent mixer stirs the developing agent during the developing process. In one type of two-component developing type, the developing agent mixer further moves the developing agent to a discharge port. The developing agent mixer discharges the developing agent little by little to the outside of the developing device during the developing process.

The image forming apparatus of one type of two-component developing type keeps the discharge amount of the developing agent constant when changing the process speed. Such an image forming apparatus is provided with a mechanism for keeping the discharge amount of the developing agent constant. As a result, the constitution of the apparatus becomes complicated. For example, the image forming apparatus reduces the developing roller linear velocity during the developing process in a thick paper mode. However, if the rotation speed of the developing agent mixer is reduced, the discharge amount of the developing agent cannot be kept constant. Thus, it is necessary to arrange a dedicated driving motor for the developing agent mixer in the image forming apparatus of one type of two-component developing type.

DETAILED DESCRIPTION

Figure 1:
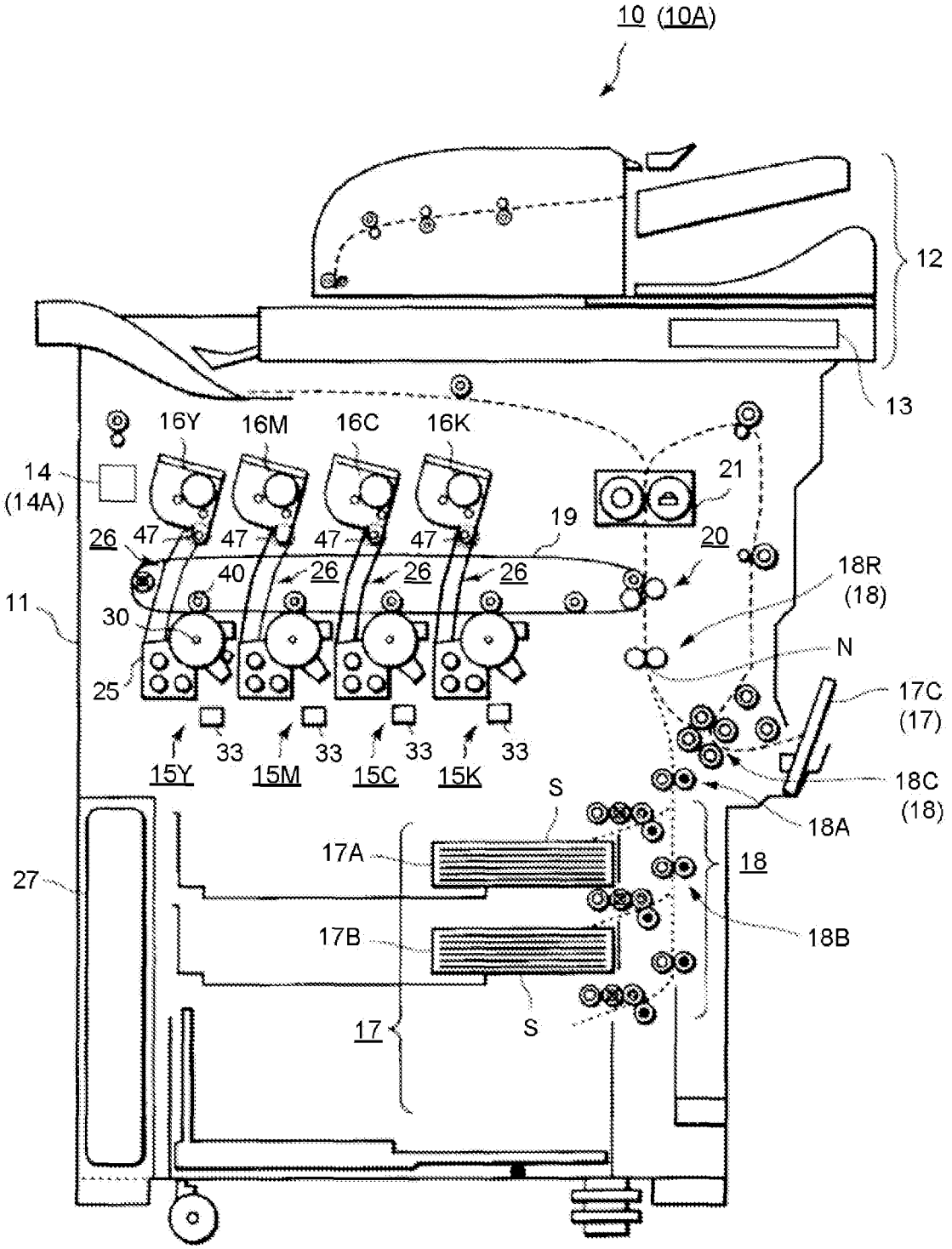
FIG. 1 is a schematic view of a cross section illustrating an example of the whole constitution of an image forming apparatus according to a first embodiment.

In accordance with one embodiment, an image forming apparatus comprises a photoconductor on which an electrostatic latent image is formed; a developing roller configured to supply developing agent containing toner to the surface of the photoconductor to develop the electrostatic latent image; a developing agent storage section, which is provided with a discharge port for discharging the developing agent, configured to store the developing agent and supply the developing agent to the developing roller; a developing agent mixer configured inside the developing agent storage section to stir the developing agent and move the developing agent towards the discharge port; a motor configured to rotate at least the developing agent mixer; a motor control section configured to rotate the motor at either a first speed at which the developing agent is not discharged from the discharge port or a second speed higher than the first speed to discharge the developing agent from the discharge port; and a device control section configured to control the motor control section to switch the rotation speed of the motor to the second speed at a timing different from the timing when the developing roller develops the electrostatic latent image.

A First Embodiment

Hereinafter, an image forming apparatus 10 according to the first embodiment is described in detail with reference to the accompanying drawings. Further, the same components are indicated by the same reference numerals in the drawings.

Figure 2:
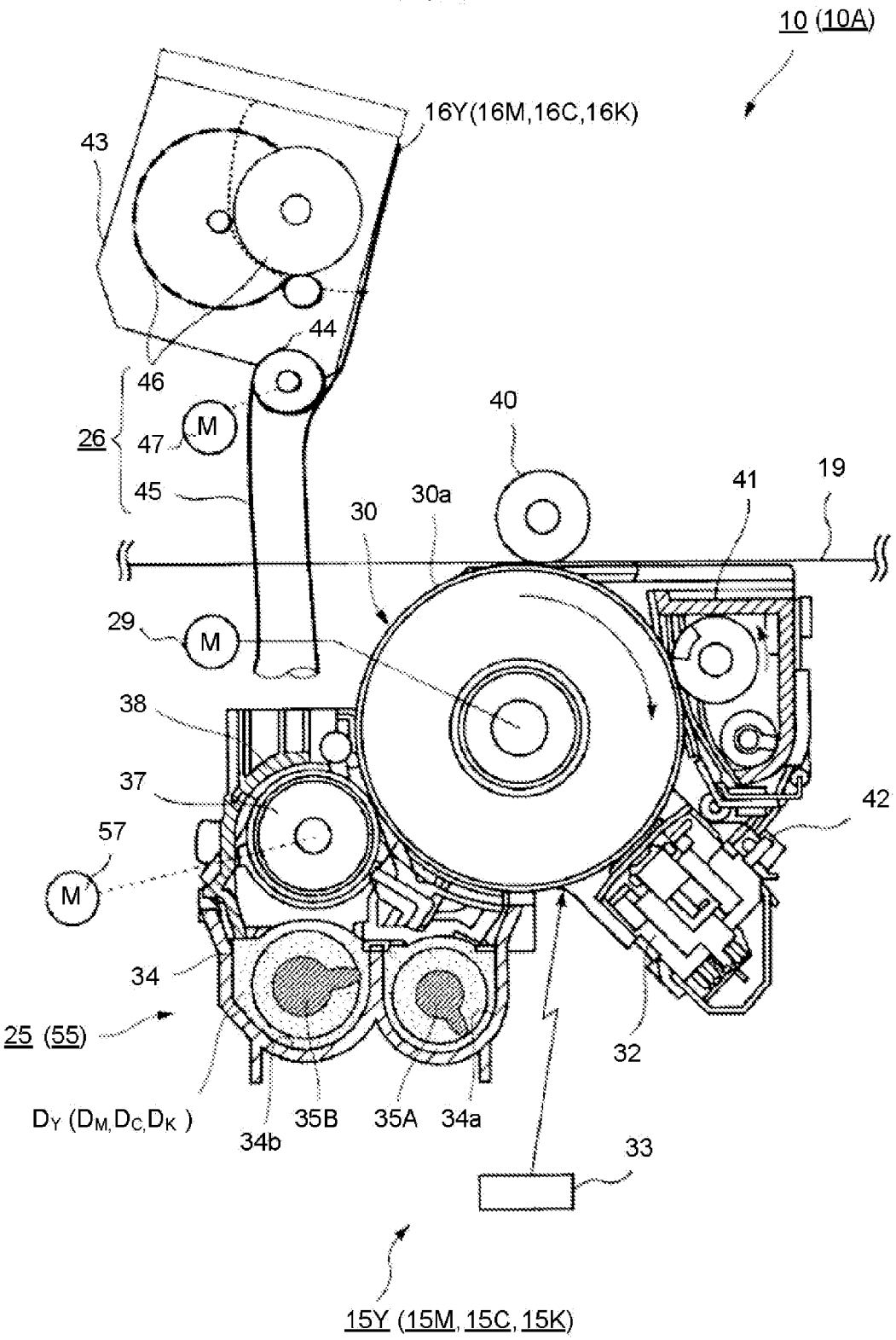
FIG. 2 is a schematic view of a cross section illustrating an example of the constitution of an image forming section of the image forming apparatus according to the first embodiment.

FIG. 1 is a schematic view of a cross section illustrating an example of the whole constitution of the image forming apparatus 10 according to the first embodiment. FIG. 2 is a schematic view of a cross section illustrating an example of the constitution of an image forming section of the image forming apparatus 10 according to the first embodiment.

As shown in FIG. 1, the image forming apparatus 10 is provided with a control panel 13, a scanner section 12, a printer section 11, a sheet storage section 17, a conveyance section 18 and a control unit 14.

The scanner section 12 reads image information of a copy object as the brightness and darkness of light. The scanner section 12 outputs the read image information to the printer section 11.

The printer section 11 forms an output image (hereinafter referred to as a toner image) with developing agent containing toner and the like based on the image information from the scanner section 12 or an external device. The printer section 11 transfers the toner image to the surface of a sheet S. The printer section 11 applies heat and pressure to the toner image on the surface of the sheet S to fix the toner image on the sheet S.

The sheet storage section 17 supplies the sheet S one by one to the printer section 11 at the timing when the toner image is formed by the printer section 11. The sheet storage section 17 includes a plurality of paper feed cassettes 17A and 17B, and a manual feeding unit 17C. Each of the paper feed cassettes 17A and 17B and the manual feeding unit 17C stores the sheets S of a preset size and category. The manual feeding unit 17C can supply the sheet S serving as thick paper that cannot be supplied from the paper feed cassettes 17A and 17B to the printer section 11. Each of the paper feed cassettes 17A and 17B and the manual feeding unit 17C is provided with a pickup roller. Each pickup roller picks up one sheet S from the paper feed cassettes 17A and 17B and the manual feeding unit 17C and supplies the picked up sheet S to the conveyance section 18.

The conveyance section 18 includes conveyance rollers 18A, 18B and 18C, and a register roller 18R. The conveyance rollers 18A and 18B convey the sheet S supplied from the paper feed cassettes 17A and 17B to the register roller 18R. The conveyance roller 18C conveys the sheet S supplied from the manual feeding unit 17C to the register roller 18R.

The register roller 18R conveys the sheet S at the timing when the printer section 11 is to transfer the toner image to the sheet S. The conveyance roller 18A (18B, 18C) contacts the front end in the conveyance direction of the sheet S with a nip N of the register roller 18R. The conveyance roller 18A (18B, 18C) deflects the sheet S to align the position of the front end of the sheet S in the conveyance direction. The register roller 18R conveys the sheet S to a later-described transfer section 20 after the front end of the sheet S conveyed from the conveyance roller 18A (18B, 18C) is aligned in the nip N.

The printer section 11 includes a plurality of image forming sections 15Y, 15M, 15C and 15K, a waste toner box 27, an intermediate transfer belt 19, an exposure section 33, the transfer section 20 and a fixing device 21.

Each of the image forming sections 15Y, 15M, 15C and 15K forms a toner image to be transferred to the sheet S on the intermediate transfer belt 19.

The intermediate transfer belt 19, which is an endless belt, is applied with tension by a plurality of rollers contacted with the inner peripheral surface thereof to be stretched in a flat shape.

As shown in FIG. 1, each of the image forming sections 15Y, 15M, 15C and 15K is provided with a cylindrical photoconductive drum 30 (photoconductor). The image forming sections 15Y, 15M, 15C and 15K form yellow, magenta, cyan and black toner images on the photoconductive drum 30, respectively.

As shown in FIG. 2, the image forming sections 15Y, 15M, 15C and 15K are structurally identical to each other except the later-described developing agent replenishment sections 16Y, 16M, 16C and 16K.

Each photoconductive drum 30 is equipped with a photoconductive layer 30*a* at the surface thereof. Each photoconductive drum 30 rotates around a rotation shaft 30*b*. Each rotation shaft 30*b* connected with a drum motor 29 is rotated in a clockwise direction in the figure by the drum motor 29. The drum linear velocity of each photoconductive drum 30 corresponds to the process speed of the image formation.

As shown in FIG. 1, each photoconductive drum 30 is arranged below the intermediate transfer belt 19 at a certain interval.

As shown in FIG. 2, a charger 32, the exposure section 33, a developing device 25, a transfer roller 40, a cleaning unit 41 and a charge removing device 42 are arranged around the photoconductive drum 30 in a clockwise direction shown in FIG. 2.

The charger 32 charges the photoconductive drum 30. For example, the charger 32 is provided with a charge electrode including a discharge wire or needle electrode.

The exposure section 33 irradiates the surface of the charged photoconductive drum 30 with LED light controlled based on the image information. The exposure section 33 may emit laser light from a laser light source. The image information of yellow (magenta, cyan or black) color is supplied to the exposure section 33 of the image forming section 15Y (15M, 15C or 15K). The charged exposure section 33 emits the LED light based on the image information to the photoconductive drum 30 to form the electrostatic latent image based on the image information of yellow (magenta, cyan or black) color on the surface of the photoconductive drum 30.

The developing device 25 of the image forming section 15Y (15M, 15C or 15K) stores the developing agent containing yellow (magenta, cyan or black) toner. The developing device 25 charges the stored toner and supplies the charged toner to the surface of the opposing photoconductive drum 30. The toner adheres to the surface of the opposing photoconductive drum 30 according to the electrostatic latent image. In this way, the developing device 25 develops the electrostatic latent image formed by the exposure section 33.

The developing device 25 carries out image developing processing in a two-component developing manner.

Hereinafter, the detailed constitution of the developing device 25 is described.

Figure 3:
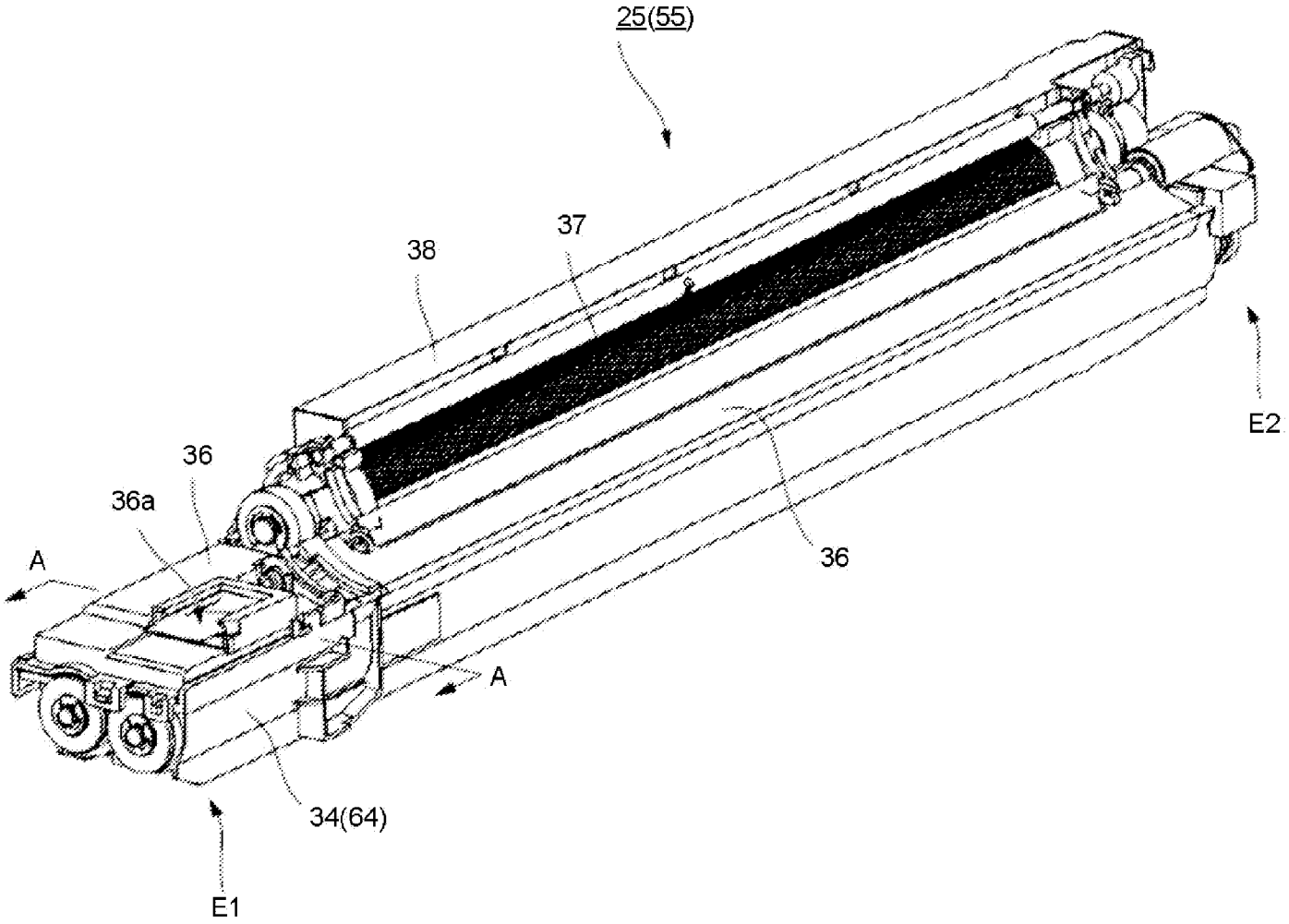
FIG. 3 is a perspective schematic view illustrating an example of the constitution of a developing device of the image forming apparatus according to the first embodiment.
Figure 4:
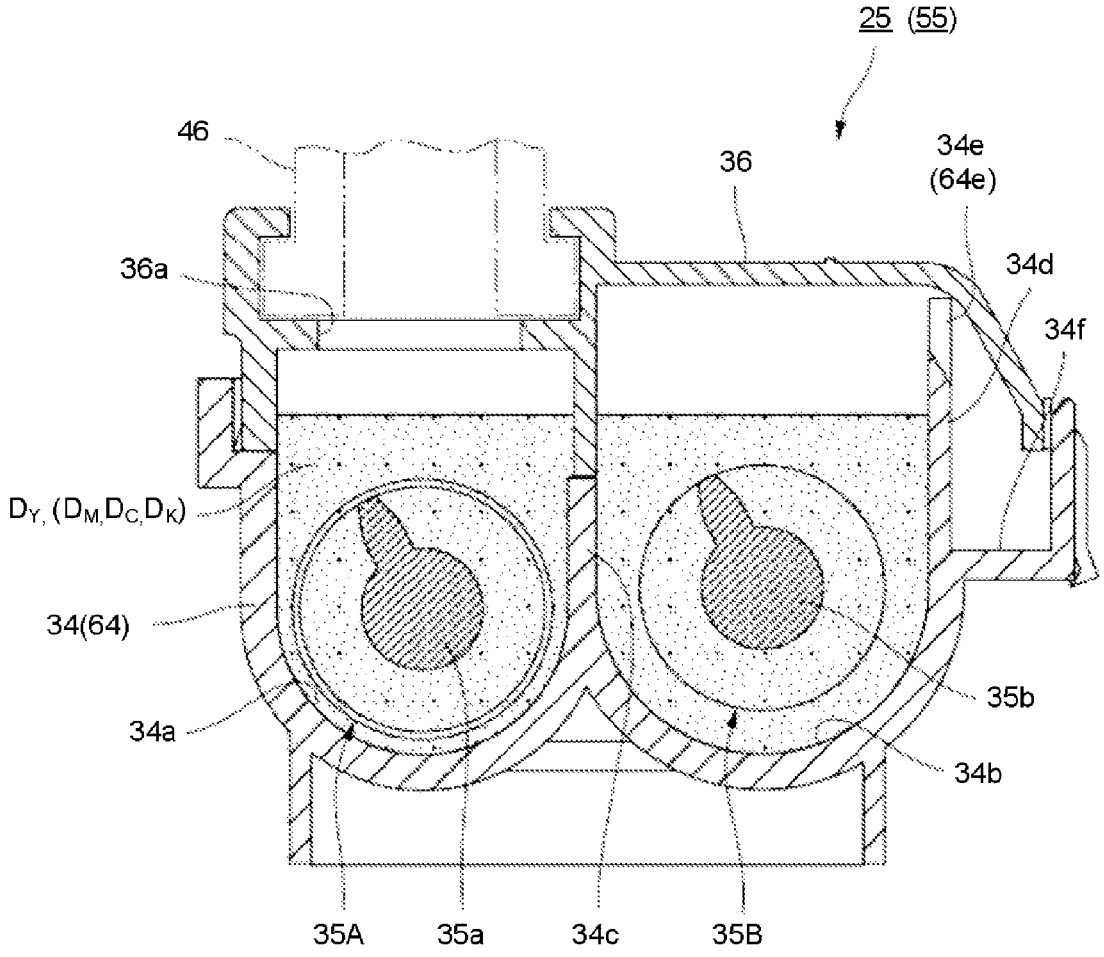
FIG. 4 is a schematic view illustrating a cross section taken in the direction of arrows A-A shown in FIG. 3.
Figure 5:
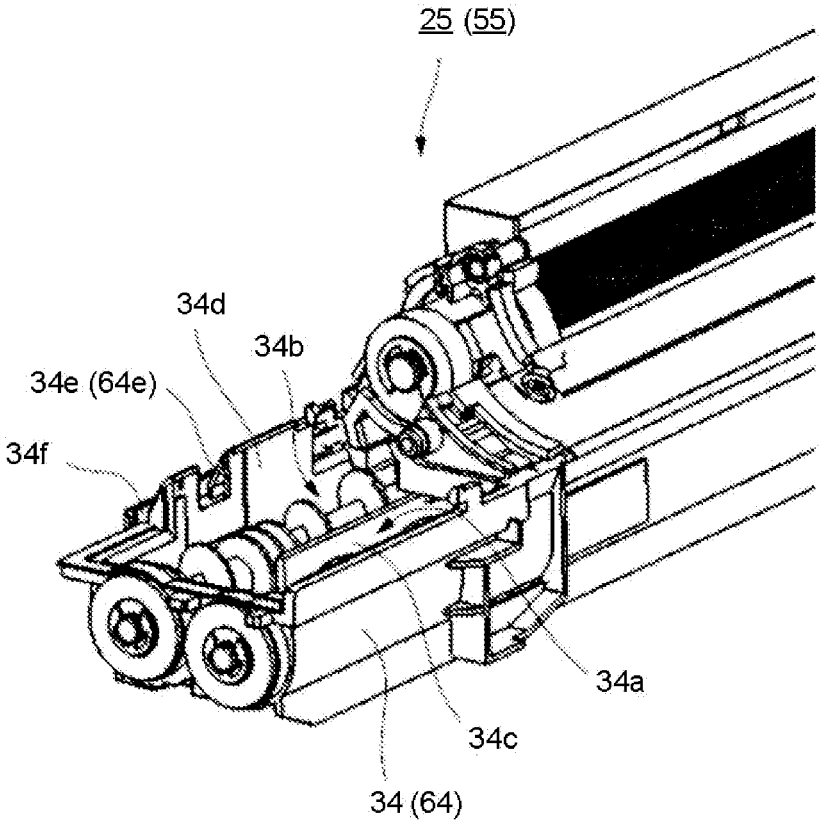
FIG. 5 is a perspective schematic view illustrating an example of the constitution of the components around a discharge port of the developing device of the image forming apparatus according to the first embodiment.
Figure 6:
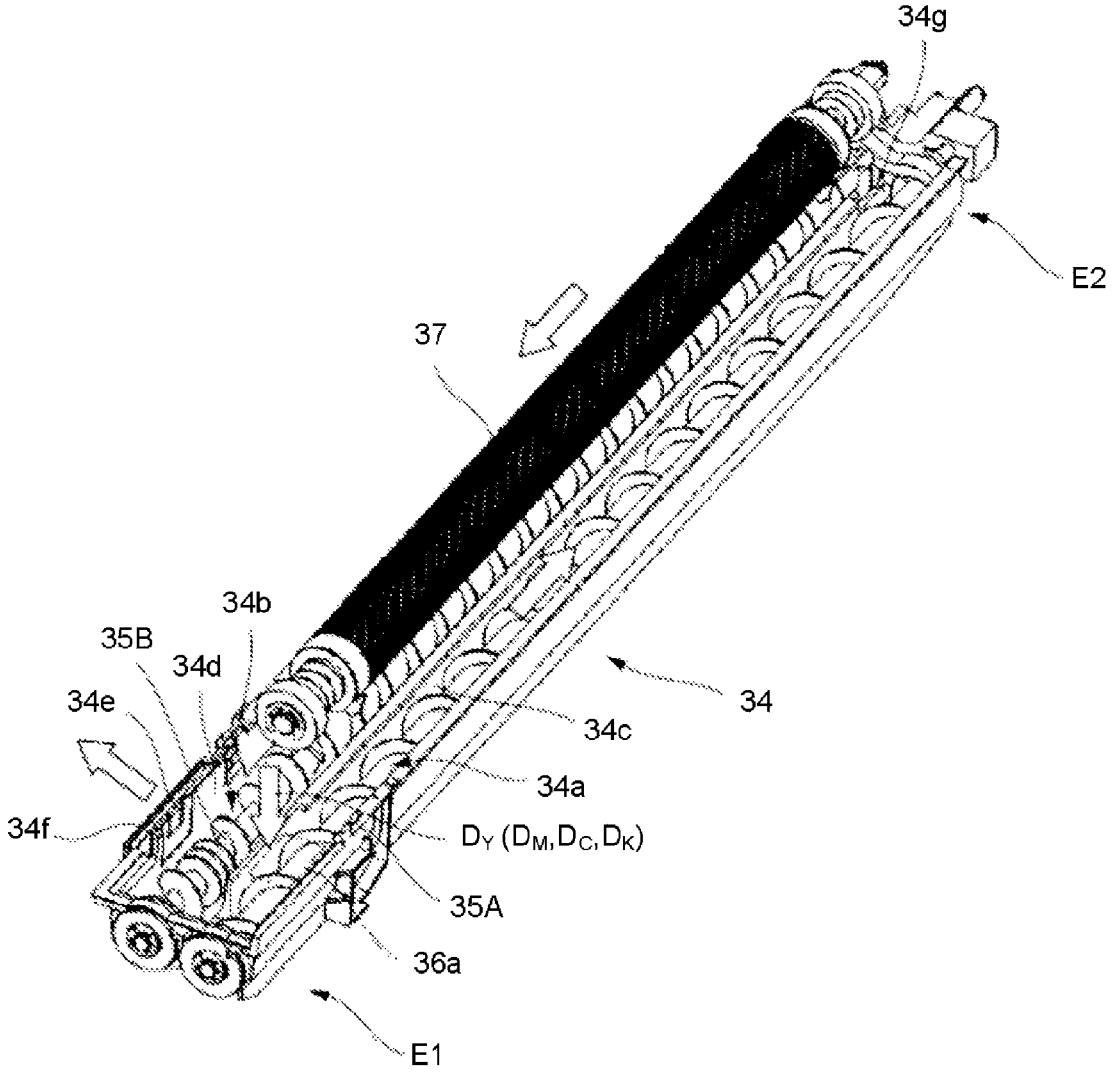
FIG. 6 is a perspective schematic view illustrating the flow of developing agent in the developing device of the image forming apparatus according to the first embodiment.

FIG. 3 is a perspective schematic view illustrating an example of the constitution of the developing device of the image forming apparatus according to the first embodiment. FIG. 4 is a schematic view illustrating a cross section taken in the direction of arrows A-A shown in FIG. 3. FIG. 5 is a perspective schematic view illustrating an example of the constitution of the components around a discharge port of the developing device of the image forming apparatus according to the first embodiment. FIG. 6 is a perspective schematic view illustrating the flow of the developing agent in the developing device of the image forming apparatus according to the first embodiment.

As shown in FIG. 2, the developing device 25 includes a developing agent storage section 34, a developing roller 37, a developing roller cover 38, a developing agent storage section cover 36 (refer to FIG. 3), a first mixer 35A (developing agent mixer) and a second mixer 35B (developing agent mixer).

The developing agent storage section 34 stores the developing agent $D_Y$ ($D_M$, $D_C$, $D_K$).

The developing agent $D_Y$ ($D_M$, $D_C$, $D_K$) is a mixture of the carrier including magnetic fine particles and yellow (magenta, cyan or black) toner. When the developing agent $D_Y$ ($D_M$, $D_C$, $D_K$) is stirred, the toner is triboelectrically charged. The charged toner adheres to the surface of the carrier.

As shown in FIG. 3, the developing agent storage section 34 extends in the longitudinal direction of the developing device 25 from a first end part E1 to a second end part E2 of the developing device 25. Herein, the first end part E1 of the developing device 25 faces the front side (paper front side of FIG. 1 and FIG. 2) of the printer section 11. The second end part E2 of the developing device 25 faces the back side (paper back side of FIG. 1 and FIG. 2) of the printer section 11.

As shown in FIG. 4, groove parts 34*a* and 34*b* which are opened upward are formed at the inside of the developing agent storage section 34. The groove parts 34*a* and 34*b* extend along the longitudinal direction from the first end part E1 to the second end part E2. The groove parts 34*a* and 34*b* are arranged side by side in the lateral direction. Each of the cross sections of the groove parts 34*a* and 34*b* in a direction orthogonal to the longitudinal direction is U-shaped. A partition plate 34*c* is formed at the boundary of the groove parts 34*a* and 34*b* in the lateral direction.

As shown in FIG. 3, the developing roller 37, the developing roller cover 38 and the developing agent storage section cover 36 are arranged above the developing agent storage section 34. The developing roller 37, the developing roller cover 38 and the developing agent storage section cover 36 face the openings of the developing agent storage section 34.

The developing roller 37 supplies the developing agent $D_Y$ ($D_M$, $D_C$, $D_K$) to the surface of the opposing photoconductive drum 30 to develop the electrostatic latent image formed on the surface of the opposing photoconductive drum 30. The developing roller 37 includes a cylindrical developing sleeve and a magnet arranged inside the developing sleeve. The magnet is applied with magnetic field distribution which carries out the napping and the bristle cutting of the developing agent $D_Y$ ($D_M$, $D_C$, $D_K$).

The developing roller 37 has a developing width longer than an electrostatic latent image forming width of the photoconductive drum 30. The roller width of the developing roller 37 is shorter than that of the developing agent storage section 34.

As shown in FIG. 2, the developing roller 37 is arranged along the opening of the groove part 34*b*. At the arrangement position of the developing roller 37, the surface of the developing sleeve is adjacent to the surface of the opposing photoconductive drum 30. As shown in FIG. 3, the developing roller 37 is arranged closer to the second end part E2 of the developing agent storage section 34.

The developing roller 37 is connected with a developing motor 57 (refer to FIG. 2). The developing motor 57 is arranged at the rear side of the printer section 11 compared with the second end part E2 of the developing device 25. The developing roller 37 is connected with the developing motor 57 directly or indirectly through a transmission mechanism. The developing motor 57 rotates the developing roller 37 at a developing linear velocity determined according to the process speed during the developing process.

The developing roller cover 38 covers the surface of the developing roller 37 except the part adjacent to the photoconductive drum 30 above the groove part 34*b*.

As shown in FIG. 3, the developing agent storage section cover 36 above the developing agent storage section 34 covers the part of the developing agent storage section 34 that is not covered by the developing roller 37 and the developing roller cover 38. The developing agent storage section cover 36 covers the entire developing agent storage section 34 at the first end part E1 of the developing device 25.

As shown in FIG. 4, a developing agent replenishment port 36*a* is formed in the developing agent storage section cover 36 at the first end part E1 of the developing device 25 above the groove part 34*a*. The developing agent replenishment port 36*a* is connected with a replenishment tube 45 of the later-described developing agent replenishment section 16Y (16M, 16C, 16K).

As shown in FIG. 4 and FIG. 5, a discharge port 34*e* is formed in the developing agent storage section 34 at the first end part E1 of the developing device 25. The discharge port 34*e* is a rectangular cutout part. The discharge port 34*e* is formed in a side wall 34*d* opposite to the partition plate 34*c* of the groove part 34*b*. The discharge port 34*e* is an opening for discharging the developing agent $D_Y$ ($D_M$, $D_C$, $D_K$) to the outside of the groove part 34*b*. A developing agent reception section 34*f* is formed at the outside of the side wall 34*d* below the discharge port 34*e*. The developing agent reception section 34*f* receives the discharged developing agent $D_Y$ ($D_M$, $D_C$, $D_K$).

The developing agent reception section 34*f* is connected with the waste toner box 27 shown in FIG. 1 through a conveyance path. The waste toner box 27 stores the developing agent discharged from the discharge port 34*e* together with the waste toner adhering to the carrier.

As shown in FIG. 4, the first mixer 35A and the second mixer 35B are arranged in the groove parts 34*a* and 34*b* of the developing agent storage section 34, respectively. For example, the first mixer 35A and the second mixer 35B extend in the longitudinal direction of the developing device 25. Further, the first mixer 35A and the second mixer 35B are equipped with helical stirring blade at the surface thereof. The first mixer 35A and the second mixer 35B are connected with the developing motor 57 through a transmission mechanism at the second end part E2 of the developing device 25. The rotation speed of the first mixer 35A and the second mixer 35B is in a constant relationship, which is determined according to a transmission gear ratio of the transmission mechanism, with the rotation speed of the developing motor 57.

The first mixer 35A and the second mixer 35B, if rotated by the developing motor 57, stir the developing agent $D_Y$ ($D_M$, $D_C$, $D_K$) in the groove parts 34*a* and 34*b*. The first mixer 35A and the second mixer 35B further convey the developing agent $D_Y$ ($D_M$, $D_C$, $D_K$) in the longitudinal direction.

As shown in FIG. 6, the first mixer 35A conveys the developing agent $D_Y$ $D_M$, $D_C$, $D_K$) replenished from the developing agent replenishment port 36*a* at the first end part E1 towards the second end part E2.

A cutout section 34*g* is formed in the partition plate 34*c* at the second end part E2. The cutout section 34*g* connects the groove parts 34*a* and 34*b* in the lateral direction. The developing agent $D_Y$ ($D_M$, $D_C$, $D_K$) conveyed by the first mixer 35A moves to the groove part 34*b* through the cutout section 34*g*.

The second mixer 35B conveys the developing agent $D_Y$ ($D_M$, $D_C$, $D_K$) flowing in from the cutout section 34*g* towards the first end part E1. The developing agent $D_Y$ ($D_M$, $D_C$, $D_K$) conveyed by the second mixer 35B is conveyed under the developing roller 37 and moved to a position nearby the discharge port 34*e*. The developing agent $D_Y$ ($D_M$, $D_C$, $D_K$) moved to the discharge port 34*e*, if stacked higher than the lower end part of the discharge port 34*e*, is discharged to the developing agent reception section 34*f*.

Incidentally, the space of the groove part 34*b* at the first end part E1 and the height of the discharge port 34*e* are determined in such a manner that the developing agent $D_Y$ ($D_M$, $D_C$, $D_K$) does not overflow from the discharge port 34*e* during the developing process. In the present embodiment, the space of the groove part 34*b* at the first end part E1 and the height of the discharge port 34*e* are determined in such a manner that the developing agent $D_Y$ ($D_M$, $D_C$, $D_K$) does not overflow from the discharge port 34*e* during the developing process for forming images on at least one sheet S.

As shown in FIG. 2, the developing agent replenishment section 16Y (16M, 16C, 16K) is provided with a cartridge container 43 and a developing agent transfer section 26.

The cartridge container 43 of the developing agent replenishment section 16Y (16M, 16C, 16K) stores the developing agent $D_Y$ ($D_M$, $D_C$, $D_K$) to be replenished to the developing device 25. A discharge port 44 for discharging the developing agent $D_Y$ ($D_M$, $D_C$, $D_K$) is arranged in the cartridge container 43.

Each developing agent transfer section 26 includes the replenishment tube 45, a replenishment motor 47 and a transfer member 46.

The replenishment tube 45 is connected with the discharge port 44 and the developing agent replenishment port 36*a* of the developing device 25. The replenishment motor 47 supplies driving force for transferring the developing agent $D_Y$ ($D_M$, $D_C$, $D_K$) in the cartridge container 43. The transfer member 46 is driven to rotate by the replenishment motor 47. The transfer member 46 moves the developing agent $D_Y$ ($D_M$, $D_C$, $D_K$) in the cartridge container 43 little by little to the discharge port 44.

The developing agent $D_Y$ ($D_M$, $D_C$, $D_K$) moved to the discharge port 44 is passed through the replenishment tube 45 and the developing agent replenishment port 36*a* and transferred to the developing agent storage section 34.

The transfer amount of the developing agent $D_Y$ ($D_M$, $D_C$, $D_K$) transferred by the developing agent transfer section 26 per unit time is pre-determined based on the process speed and the amount of the toner required in the image formation.

The transfer roller 40 is arranged opposite to the photoconductive drum 30 across the intermediate transfer belt 19 which contacts with the surface of the opposing photoconductive drum 30. The transfer roller 40 transfers (primarily transfers) the toner image on the surface of the opposing photoconductive drum 30 to the intermediate transfer belt 19.

Each image forming section 15Y (15M, 15C, 15K) applies a transfer bias voltage to the transfer roller 40 at a primary transfer position.

The cleaning unit 41, for example, scrapes the non-transferred toner left on the surface of the opposing photoconductive drum 30 after the primary transfer to remove the non-transferred toner.

The charge removing device 42 emits light to the surface of the opposing photoconductive drum 30 passing through the cleaning unit 41 to remove the charge of the photoconductive drum 30.

A transfer section 20 is arranged at the intermediate transfer belt 19 at a position adjacent to the image forming section 15K.

The transfer section 20 transfers the charged toner image on the intermediate transfer belt 19 to the surface of the sheet S at a secondary transfer position. The transfer section 20 sets a position where a support roller and the secondary transfer roller face each other as the secondary transfer position. The transfer section 20 applies the transfer bias voltage controlled through transfer current to the secondary transfer position to transfer the toner image on the intermediate transfer belt 19 to the sheet S through the transfer bias voltage.

The fixing device 21 fixes the toner image on the surface of the sheet S onto the sheet S through heat and pressure applied to the sheet S.

The control unit 14 controls the image forming apparatus 10. As shown by an example of constitution of the main portions shown in FIG. 7, the control unit 14 includes a system control section 100 for controlling the whole image forming apparatus 10, and a plurality of device control sections for controlling each device. The plurality of device control sections includes at least a printer section control section 101 (device control section) for controlling the operations of the printer section 11 of the image forming apparatus 10. The control unit 14 further includes device control sections for controlling the operations of the control panel 13 and the scanner section 12.

The printer section control section 101 carries out a control on a plurality of control sections which controls the operations of each device included in the printer section 11. For example, the printer section control section 101 controls a drum motor control section 104, a developing motor control section 102 (motor control section), a replenishment motor control section 103 and a developing control section 105. The printer section control section 101 further controls other control sections which control the exposure section 33, the conveyance section 18, the charger 32, the transfer roller 40, the cleaning unit 41 and the charge removing device 42.

The system control section 100, the printer section control section 101 and other control sections are realized through a CPU (central processing unit), ROM (read only memory), RAM (random access memory) and other hardware.

A program in which a procedure for executing later-described control function and calculation function is recorded is copied or decompressed on the RAM. The CPU executes the program. Numeric values corresponding to later-described control condition are stored in the ROM.

The drum motor control section 104 controls the rotation speed and the rotation timing of each drum motor 29 in the image forming sections 15Y, 15M, 15C and 15K. The rotation speed of the drum motor 29 specifies the linear velocity of the photoconductive drum 30. On the other hand, the linear velocity of the photoconductive drum 30 is selected from a plurality of linear velocities according to the thickness, the material and the like of the sheet S. For example, in the image forming apparatus 10, the linear velocity of the printer section 11 can be switched between a linear velocity $U_S$ and a linear velocity $U_T$ ($U_T<U_S$). The linear velocity $U_S$ is a linear velocity of a normal paper mode in which a normal paper is used as the sheet S. The linear velocity $U_T$ is a linear velocity of a thick paper mode in which a thick paper that needs more heat in the fixation than the normal paper is used.

The switch between the normal paper mode and the thick paper mode is carried out based on an input from the control panel 13 or a control signal (hereinafter referred to as a mode selection signal) from an external device.

The system control section 100 analyzes the mode selection signal and notifies the printer section control section 101 that the normal paper mode or the thick paper mode is input.

The printer section control section 101, if receiving a notification indicating the normal paper mode, sets a rotation speed $U_S$ corresponding to the linear velocity $U_S$ for the drum motor control section 104. The printer section control section 101, if receiving a notification indicating the thick paper mode, sets a rotation speed $u_t$ corresponding to the linear velocity $U_T$ for the drum motor control section 104.

The developing motor control section 102 controls the rotation speed and the rotation timing of each developing motor 57 in the image forming sections 15Y, 15M, 15C and 15K. In the present embodiment, the developing motor 57 rotates the developing roller 37, the first mixer 35A and the second mixer 35B. The rotation speed ratio and the rotation directions of the developing roller 37, the first mixer 35A and the second mixer 35B are fixed.

The rotation speed of the developing motor 57 during the developing process is set to a certain rotation speed so that the linear velocity of the developing roller 37 becomes a developing linear velocity determined according to the linear velocity of the photoconductive drum 30.

On the other hand, the rotation speed of the first mixer 35A and the second mixer 35B specified the moving speed of the developing agent $D_Y$ ($D_M$, $D_C$, $D_K$). The rotation speed of the first mixer 35A and the second mixer 35B during the developing process is set to such a rotation speed that a required amount of developing agent $D_Y$ ($D_M$, $D_C$, $D_K$) can be supplied to the developing roller 37.

When the first mixer 35A and the second mixer 35B are rotated during the developing process, the developing agent $D_Y$ ($D_M$, $D_C$, $D_K$) is conveyed to a position nearby the discharge port 34*e*. In the present embodiment, the rotation speed during the developing process is set to such a degree that the developing agent $D_Y$ ($D_M$, $D_C$, $D_K$) is not discharged from the discharge port 34*e*. That is, the width of the groove part 34*b* at the first end part E1 and the height of the discharge port 34*e* are great enough to cope with the maximum conveyance amount of the developing agent $D_Y$ ($D_M$, $D_C$, $D_K$) in a case of a highest rotation speed during the developing process.

In the following description, the rotation speed of the developing motor 57 during the developing process is referred to as a rotation speed V1 (first speed). In the present embodiment, the rotation speed V1 can be switched between $V1_S$ and $V1_T$ ($V1_T<V1_S$) according to the linear velocities $U_S$ and $U_T$ of the photoconductive drum 30.

Further, the developing motor control section 102 can switch the rotation speed of the developing motor 57 to a rotation speed V2 (second speed). The rotation speed V2 is higher than both of the rotation speeds V1.

The rotation speed V2 is such a high rotation speed that a certain amount of developing agent $D_Y$ ($D_M$, $D_C$, $D_K$) conveyed to a position nearby the discharge port 34*e* is discharged from the discharge port 34*e*. The certain amount of developing agent $D_Y$ ($D_M$, $D_C$, $D_K$) to be discharged is pre-determined based on degradation amount caused by the stirring of the developing agent $D_Y$ ($D_M$, $D_C$, $D_K$).

Next, the control of the rotation timing in the developing motor control section 102 is described in detail together with the operations of the image forming apparatus 10 described later.

The replenishment motor control section 103 controls the rotation speed and the rotation timing of each replenishment motor 47 in the image forming sections 15Y, 15M, 15C and 15K. The replenishment motor control section 103 measures the discharge amount with a counter (not shown). When the counter detects that a pre-determined amount of toner is discharged, the replenishment motor control section 103 controls the replenishment motor 47 to replenish the pre-determined amount of developing agent $D_Y$ ($D_M$, $D_C$, $D_K$).

The developing control section 105 controls the developing operations of other devices in each developing device 25 than the developing motor 57. For example, the developing control section 105 controls the developing bias voltage and the napping and the bristle cutting of the developing agent $D_Y$ ($D_M$, $D_C$, $D_K$).

The developing control section 105 applies a developing bias voltage for developing the electrostatic latent image with toner to the developing roller 37 during the developing process. The developing control section 105 applies a developing bias voltage which does not develop the electrostatic latent image with toner to the developing roller 37 during a non-developing process.

The developing control section 105 rotates the magnet of each developing motor 57 during the developing process to form a magnetic field distribution which carries out the napping of the developing agent $D_Y$ ($D_M$, $D_C$, $D_K$) on the each developing roller 37. The developing control section 105 rotates the magnet of each developing motor 57 during the non-developing process to form a magnetic field distribution which carries out the bristle cutting of the developing agent $D_Y$ ($D_M$, $D_C$, $D_K$) on the each developing roller 37.

Next, as to the operations of the image forming apparatus 10, the operations relating to the developing agent discharge control method according to the present embodiment are mainly described.

Figure 8:
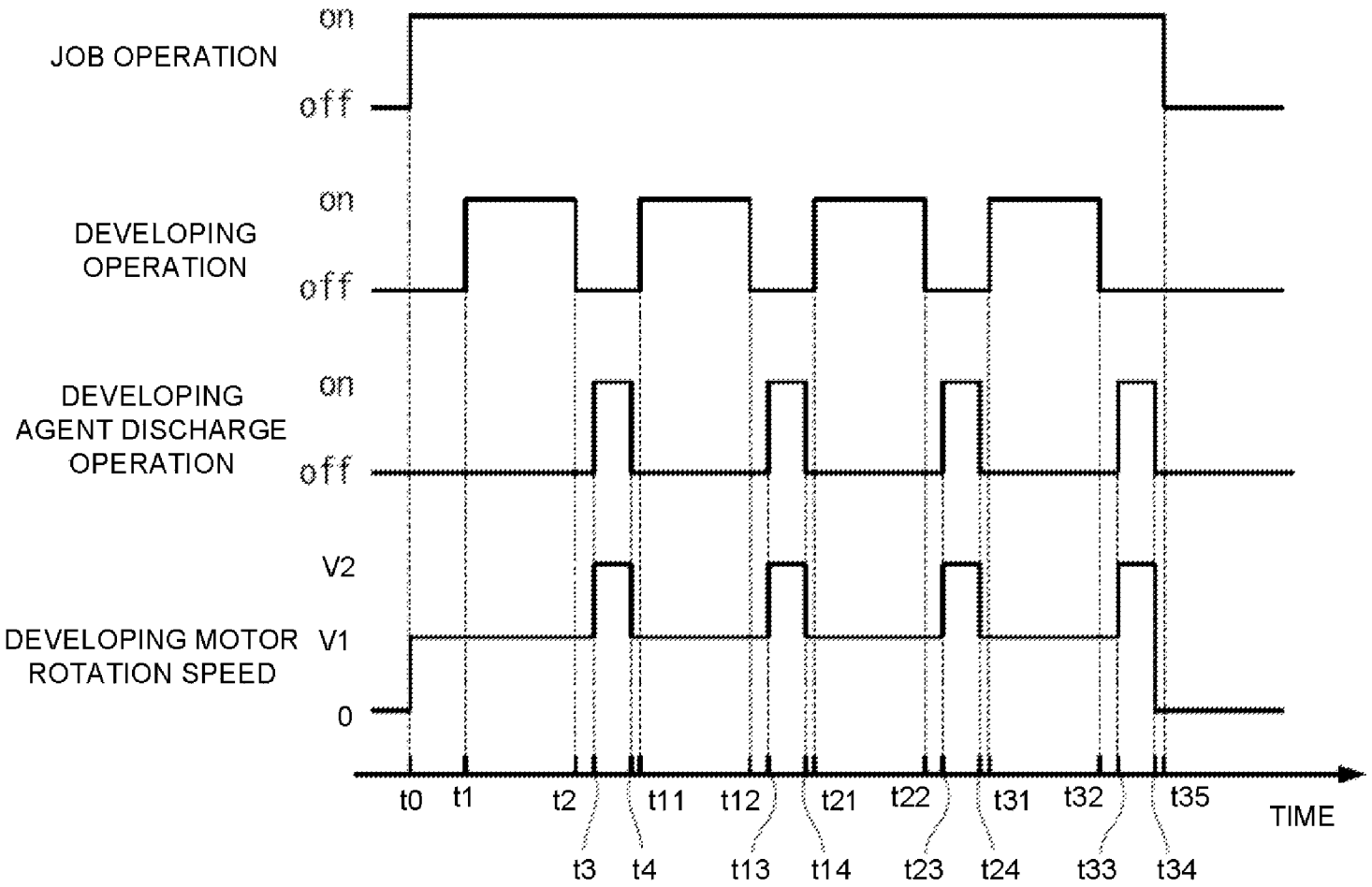
FIG. 8 is a timing chart illustrating an example of the operations of the image forming apparatus according to the first embodiment.
Figure 9:
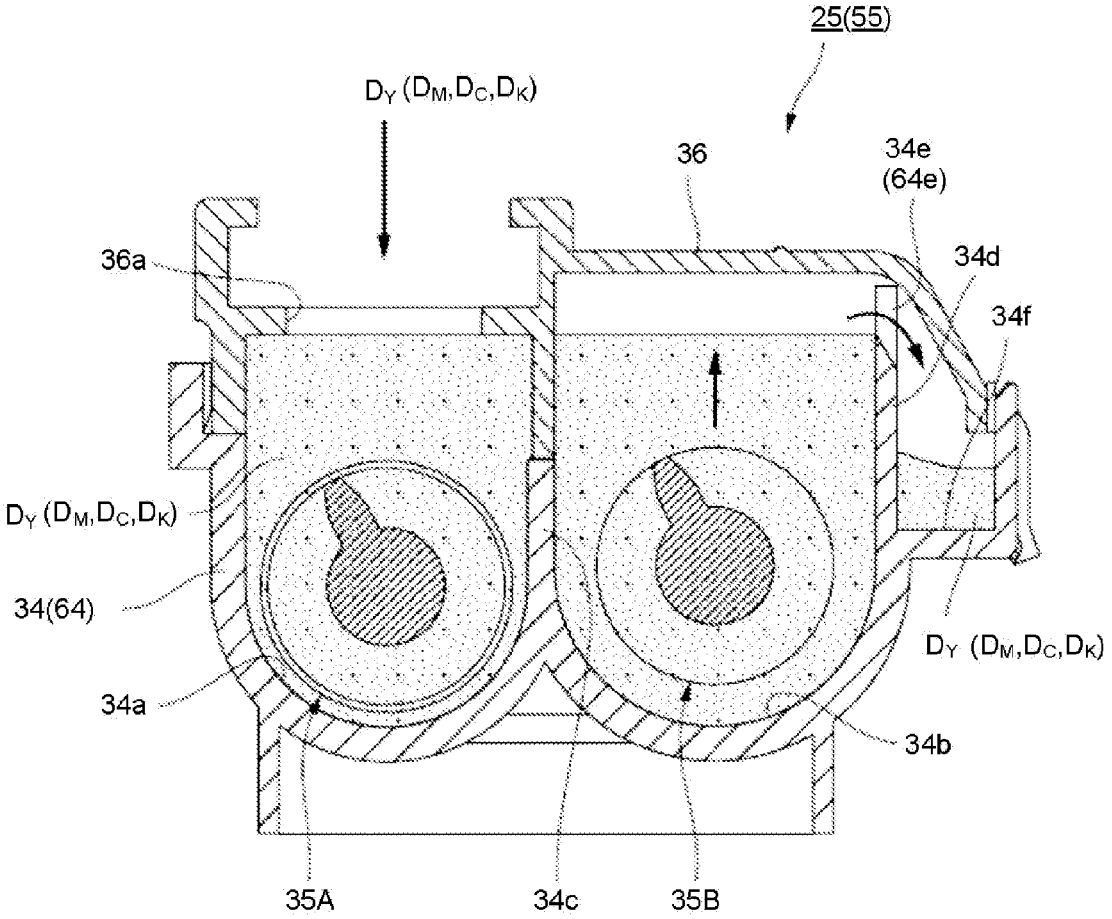
FIG. 9 is a schematic view of a cross section illustrating the operations of the image forming apparatus according to the first embodiment.

FIG. 8 is a timing chart illustrating an example of the operations of the image forming apparatus according to the first embodiment. FIG. 9 is a schematic view of a cross section illustrating the operations of the image forming apparatus according to the first embodiment.

As an example, FIG. 8 shows a schematic timing chart illustrating an example of the operations of the image forming apparatus 10 in a case of forming images on four sheets S of the same size. FIG. 8 further shows the operations of each image forming section 15Y, 15M, 15C and 15K. The operations are carried out so that the toner image formed by each image forming section 15Y, 15M, 15C and 15K is overlapped on the intermediate transfer belt 19. Thus, the operations are executed at timing with an appropriate time difference. Times to (n=1, . . . , 34) on the abscissa in FIG. 8 are different according to each image forming section 15Y, 15M, 15C and 15K. In the following description, the value of the subscript n of t shown in one timing chart indicates the preceding/following time relation unless otherwise specified. That is, in a case of i<j, ti<tj.

At time t0, a job start signal (hereinafter referred to as a job start signal for short) based on the operation of the control panel 13 or an external signal occurs. The system control section 100 detects the job start signal. The image forming apparatus 10 starts the image forming processing. The image information is obtained by reading the copy object by the scanner section 12 and then sent to the printer section 11; alternatively, the image information is sent to the printer section 11 from the external device.

The printer section control section 101 sends a control signal to the control section of each device of the printer section 11 to enable each device to carry out the following operations. In the present embodiment, the operations in the normal paper mode are the same as the operations in the thick paper mode except for the process speed.

The conveyance section 18 feeds one sheet S from the sheet storage section 17 to the register roller 18R.

The image forming sections 15Y, 15M, 15C and 15K carryout charging, exposure, developing and transfer processing based on the image information corresponding to each color to form toner images to be transferred to the sheet S on the intermediate transfer belt 19.

The developing control section 105 applies a developing bias voltage used in the non-developing process to the developing roller 37 at the time t0 and switches the magnet to the bristle cutting position.

The developing motor control section 102 starts the rotation of the developing motor 57 at the time t0. The developing motor control section 102 controls the rotation speed of the developing motor 57 to the rotation speed V1.

The developing control section 105 starts developing processing at time t1. The time t1 is the timing immediately before the image forming front end position on the photoconductive drum 30 reaches a position (hereinafter referred to as a developing position) facing the developing roller 37.

The developing control section 105 terminates the developing processing at time t2. The time t2 is the timing immediately after the image forming rear end position on the photoconductive drum 30 passes through the developing position. At the time t2, the developing control section 105 switches the magnet to the bristle cutting position. Then, the developing processing corresponding to the image to be transferred to the first sheet is completed.

In the developing operation during the time t1~t2, the developing agent $D_Y$ ($D_M$, $D_C$, $D_K$) is moved in the developing agent storage section 34 through the rotation of the first mixer 35A and the second mixer 35B. The developing agent $D_Y$ ($D_M$, $D_C$, $D_K$) is moved from the first end part E1 to the second end part E2 by the first mixer 35A in the groove part 34*a*. Further, the developing agent $D_Y$ ($D_M$, $D_C$, $D_K$) is moved to the groove part 34*b* through the cutout section 34*g*.

The developing agent $D_Y$ ($D_M$, $D_C$, $D_K$) is moved from the second end part E2 to the first end part E1 in the groove part 34*b*. The developing agent $D_Y$ ($D_M$, $D_C$, $D_K$) reaches to a position nearby the discharge port 34*e*. However, in the present embodiment, the developing agent $D_Y$ ($D_M$, $D_C$, $D_K$) does not overflow from the discharge port 34*e* at least during the developing processing of the image to be transferred to the first sheet. Thus, the developing agent $D_Y$ ($D_M$, $D_C$, $D_K$) is not discharged from the discharge port 34*e*.

At time t3 after the time t2, the developing motor control section 102 switches the rotation speed of the developing motor 57 to the rotation speed V2. As shown in FIG. 9, the amount of the developing agent $D_Y$ ($D_M$, $D_C$, $D_K$) moved to a position nearby the discharge port 34*e* is increased. If the stacking amount of the developing agent $D_Y$ ($D_M$, $D_C$, $D_K$) is greater than the height of the discharge port 34*e*, the developing agent $D_Y$ ($D_M$, $D_C$, $D_K$) is discharged to the outside of the groove part 34*b* through the discharge port 34*e*. In the present embodiment, the developing agent $D_Y$ ($D_M$, $D_C$, $D_K$), after discharged to the developing agent reception section 34*f*, is moved to the waste toner box 27 through the conveyance path.

At time t4, the developing motor control section 102 returns the rotation speed of the developing motor 57 to the rotation speed V1. Thus, the discharge of the developing agent $D_Y$ ($D_M$, $D_C$, $D_K$) is stopped at the time t4.

In this way, during the time t3~t4, a certain amount of developing agent $D_Y$ ($D_M$, $D_C$, $D_K$) is discharged from the developing agent storage section 34.

The time t4 is the time after the time t3 and before time t11 when the developing of the toner image to be transferred to the second sheet S is started.

In this way, during the time t0~t11, the developing operation of the toner image to be transferred to the first sheet S and the developing agent discharge operation are terminated.

The developed toner image is transferred to the intermediate transfer belt 19. Further, the toner images are overlapped in sequence within the width of an image forming area as the intermediate transfer belt 19 is moved. The toner image is conveyed to the transfer section 20 and secondarily transferred to the sheet S conveyed from the register roller 18R to the transfer section 20. The secondarily transferred toner image is fixed on the sheet S by the fixing device 21.

On the other hand, in the image forming section 15Y (15M, 15C and 15K), during the time t11~t14, the same operations as those carried out during the time t1~t4 are repeated. In this way, the toner image to be transferred to the second sheet S is developed. A certain amount of developing agent $D_Y$ ($D_M$, $D_C$, $D_K$) is discharged. Further, during time t21~t24 and time t31~t34, the same operations as those carried out during the time t1~t4 are repeated. In this way, the toner images to be transferred to the third and the fourth sheets S are developed. However, at the time t34, the developing motor control section 102 stops the rotation of the developing motor 57. The time t34 is the timing when the last developing agent discharge operation in one job is completed in the image forming section 15Y (15M, 15C and 15K).

The system control section 100, if confirming that the operation of each device control section is completed after the time t34, terminates the image forming operation of the image forming apparatus 10 at time t35. In this way, the job of the operation example is terminated.

The image forming apparatus 10 does not discharge the developing agent $D_Y$ ($D_M$, $D_C$, $D_K$) during the developing process in both of the normal paper mode and the thick paper mode. However, the image forming apparatus 10 rotates the developing motor 57 at the rotation speed V2 during the timing of the non-developing process. The image forming apparatus 10 discharges a certain amount of developing agent $D_Y$ ($D_M$, $D_C$, $D_K$) from the developing device 25 during the non-developing process.

In a case of an image forming apparatus according to the conventional technology which discharges the developing agent during the developing process, in the thick paper mode, the developing linear velocity is low. In this state, the discharge amount of the developing agent is low, which accelerates the degradation of the developing agent. Thus, the developing agent mixer is driven at a constant speed by other motor than the developing motor.

The image forming apparatus 10 according to the present embodiment does not carry out the developing agent discharge operation during the developing process. The image forming apparatus 10 changes the rotation speed of the developing motor 57 during the non-developing process to carry out the developing agent discharge operation. No failure occurs in the developing operation and the developing agent discharge operation even if the developing roller 37, the first mixer 35A and the second mixer 35B are driven only by the developing motor 57. The image forming apparatus 10 does not need other motor for driving the first mixer 35A and the second mixer 35B, which simplifies the constitution of the image forming apparatus 10 compared with the conventional technology.

In the image forming apparatus 10, the developing agent $D_Y$ ($D_M$, $D_C$, $D_K$) on the developing roller 37 is subjected to bristle cutting processing during the developing agent discharge operation. The developing agent $D_Y$ ($D_M$, $D_C$, $D_K$) subjected to bristle cutting processing is not in contact with the photoconductive drum 30. Thus, the degradation of the photoconductive drum 30 can be prevented even if the developing roller 37 is rotated at a high speed higher than the developing linear velocity. Further, it is possible to prevent the toner from adhering to the photoconductive drum 30 even if the developing roller 37 is rotated at a high speed higher than the developing linear velocity.

The image forming apparatus 10 in the present embodiment carries out the developing agent discharge operation every time the developing of the image formation on one sheet S is completed. In the image forming apparatus 10, a certain amount of degraded developing agent is discharged prior to the developing processing on the next sheet S. Thus, the image forming apparatus 10 can keep the state of the developing agent good.

Hereinafter, a modification of the first embodiment is described.

In the image forming apparatus 10 according to the first embodiment described above, the printer section control section 101 carries out the developing agent discharge operation every time the developing of the image formation on one sheet S is completed. However, the printer section control section 101 may carry out the developing agent discharge operation at other timing as long as the timing is not during the developing process.

For example, the printer section control section 101 may switch the rotation speed of the developing roller 37 to the rotation speed V2 every time the developing operation in one job is completed.

Figure 10:
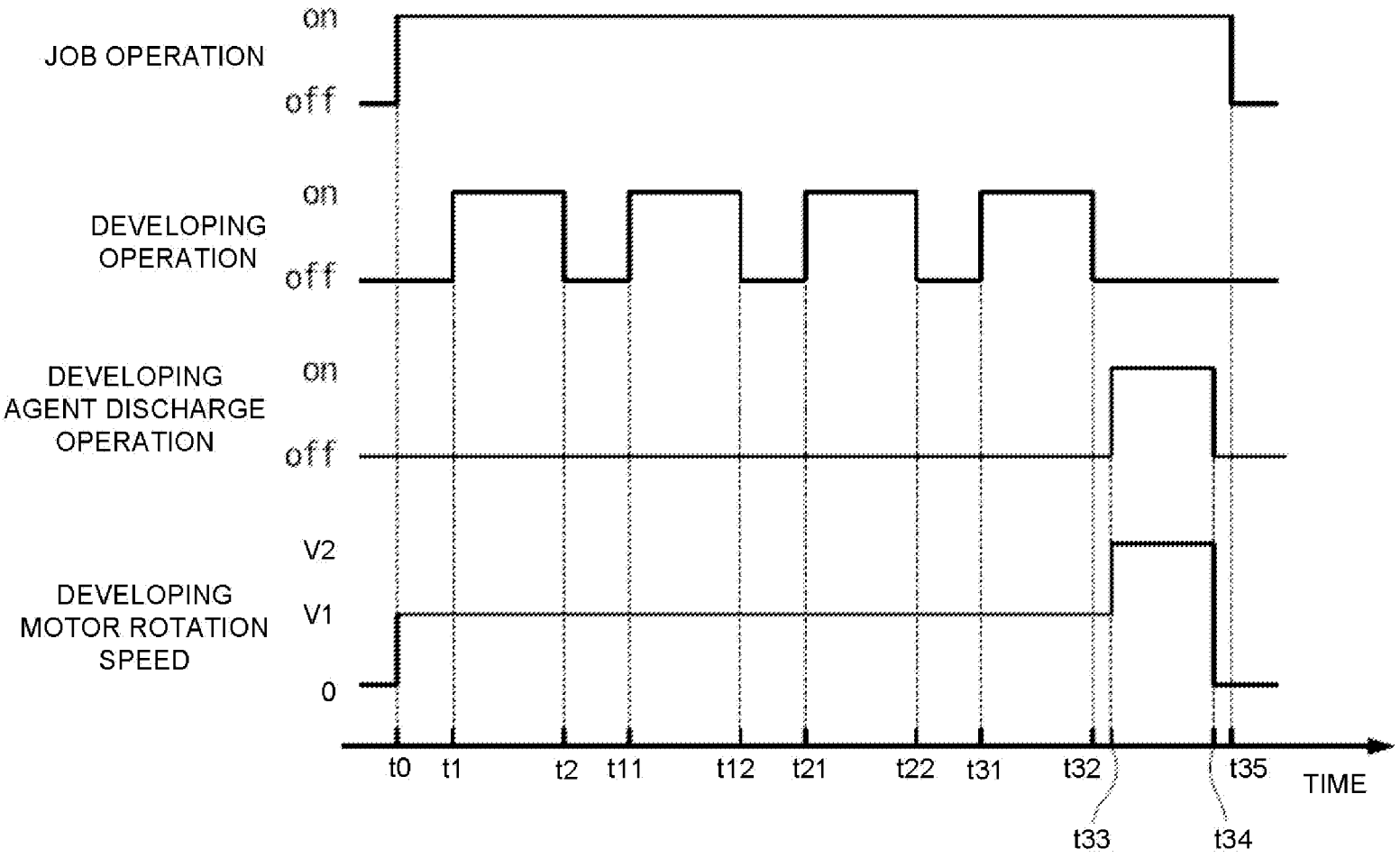
FIG. 10 is a timing chart illustrating an example of the operations of the image forming apparatus according to a modification of the first embodiment.

FIG. 10 is a timing chart illustrating an example of the operations of the image forming apparatus according to the modification of the first embodiment. In FIG. 10, the operations of the image forming apparatus 10 according to the modification in a case of forming images on four sheets S of the same size are shown as an example.

FIG. 10 shows the operations of each image forming section 15Y, 15M, 15C and 15K. As stated in the first embodiment described above, the operations are executed at timing with an appropriate time difference.

At time t0, the system control section 100 detects a job start signal. The image forming apparatus 10 according to the modification starts the image forming processing. The image information is obtained by reading the copy object by the scanner section 12 and then sent to the printer section 11; alternatively, the image information is sent to the printer section 11 from the external device.

The printer section control section 101 according to the modification sends a control signal to the control section of each device of the printer section 11 to enable each device to carry out the following operations.

The image forming sections 15Y, 15M, 15C and 15K carry out charging, exposure, developing and transfer processing based on the image information corresponding to each color to form toner images to be transferred to the sheet S on the intermediate transfer belt 19.

The developing control section 105 carries out the same control as that described in the operation example in the first embodiment. That is, the developing control section 105 carries out the control of the developing operations described above during the time t1~t2, t11~t12, t21~t22 and t31~t32.

On the other hand, similar to that described in the first embodiment, the developing motor control section 102 starts the rotation of the developing motor 57 at the rotation speed V1 at the time t0. However, the developing motor control section 102 keeps the rotation speed of the developing motor 57 at the rotation speed V1 until the developing of one job is completed, which is different from the first embodiment.

At time t33 after the time t32, the developing motor control section 102 switches the rotation speed of the developing motor 57 to the rotation speed V2 to start the same developing agent discharge operation as that described in the first embodiment.

The developing motor control section 102 stops the rotation of the developing motor 57 at the time t34 after the time t33. The time t34 in the modification is the timing when the discharge of a certain amount of developing agent $D_Y$ ($D_M$, $D_C$, $D_K$) that needs to be discharged is completed. The time (t34~t33) when the developing agent discharge operation is carried out is set according to the amount of the developing agent that needs to be discharged occurring during the time t0~t33. Thus, the time (t34~t33) in FIG. 10 is different from the time (t34~t33) in the operation example shown in FIG. 8.

The system control section 100, if confirming that the operation of each device control section is completed after the time t34, terminates the image forming operation of the image forming apparatus 10 at time t35. In this way, one job is completed.

In accordance with the image forming apparatus 10 of the modification, only the timing of the developing agent discharge operation is different from the first embodiment described above. Thus, similar to the first embodiment described above, the constitution of the image forming apparatus 10 is simplified compared with the conventional technology. The degradation of the photoconductive drum 30 and the adhering of the toner to the photoconductive drum 30 can be prevented even if the developing roller 37 is rotated at a high speed higher than the developing linear velocity.

Further, according to the image forming apparatus 10 of the modification, the developing agent discharge operation can be carried out longer than the interval (hereinafter referred to as a developing interval) between the developing operation and the next developing operation.

Further, in the image forming apparatus 10 according to other modification, the printer section control section 101 may carry out the developing agent discharge operation for a plurality of times less than the number of the sheets to be subjected to image forming processing during one job. For example, the printer section control section 101 may carry-out the developing agent discharge operation for a plurality of times every time the developing of N (N is an integer larger than 2) sheets is completed during one job. In a case in which the total number of sheets in one job is not divisible by N, one developing agent discharge operation may be carried out at the timing when all the developing operations in one job are completed.

In the image forming apparatus 10 according to other modification, the printer section control section 101 may carry out, before the next developing is carried out, the developing agent discharge operation after the developing of a certain number (N) of sheets is completed, without regard to the job.

Moreover, in the image forming apparatus 10 according to other modification, the printer section control section 101 may predict the discharge amount of the developing agent. The printer section control section 101 according to the modification determines the timing to carryout the developing agent discharge operation during the non-developing process based on the predicted discharge amount. For example, the printer section control section 101 calculates the discharge amount of the developing agent when carrying out the developing agent discharge operation based on the discharge time and the like. The printer section control section 101 accumulates the rotation amount of the first mixer 35A and the second mixer 35B since the developing agent is discharged the last time. The printer section control section 101 predicts, according to the accumulated value of the rotation amount, the number X of the sheets to be subjected to image formation until it is necessary to discharge the developing agent. The discharge amount of the developing agent that needs to be discharged varies according to the developing time corresponding to the paper passing direction and the size of the sheet S. The printer section control section 101 carries out the developing agent discharge operation during the non-developing process before the number of printings instructed from the system control section 100 exceeds the number X of the sheets to be subjected to image formation.

In the modification, the discharge amount of the developing agent may be predicted based on a detection value of a sensor for detecting a physical quantity relating to the discharge amount.

A Second Embodiment

Hereinafter, an image forming apparatus 10A according to the second embodiment is described in detail with reference to the accompanying drawings. Further, the same components in the second embodiment as those described in the first embodiment are indicated by the same reference numerals in the drawings and repetitive description is not provided.

Figure 7:
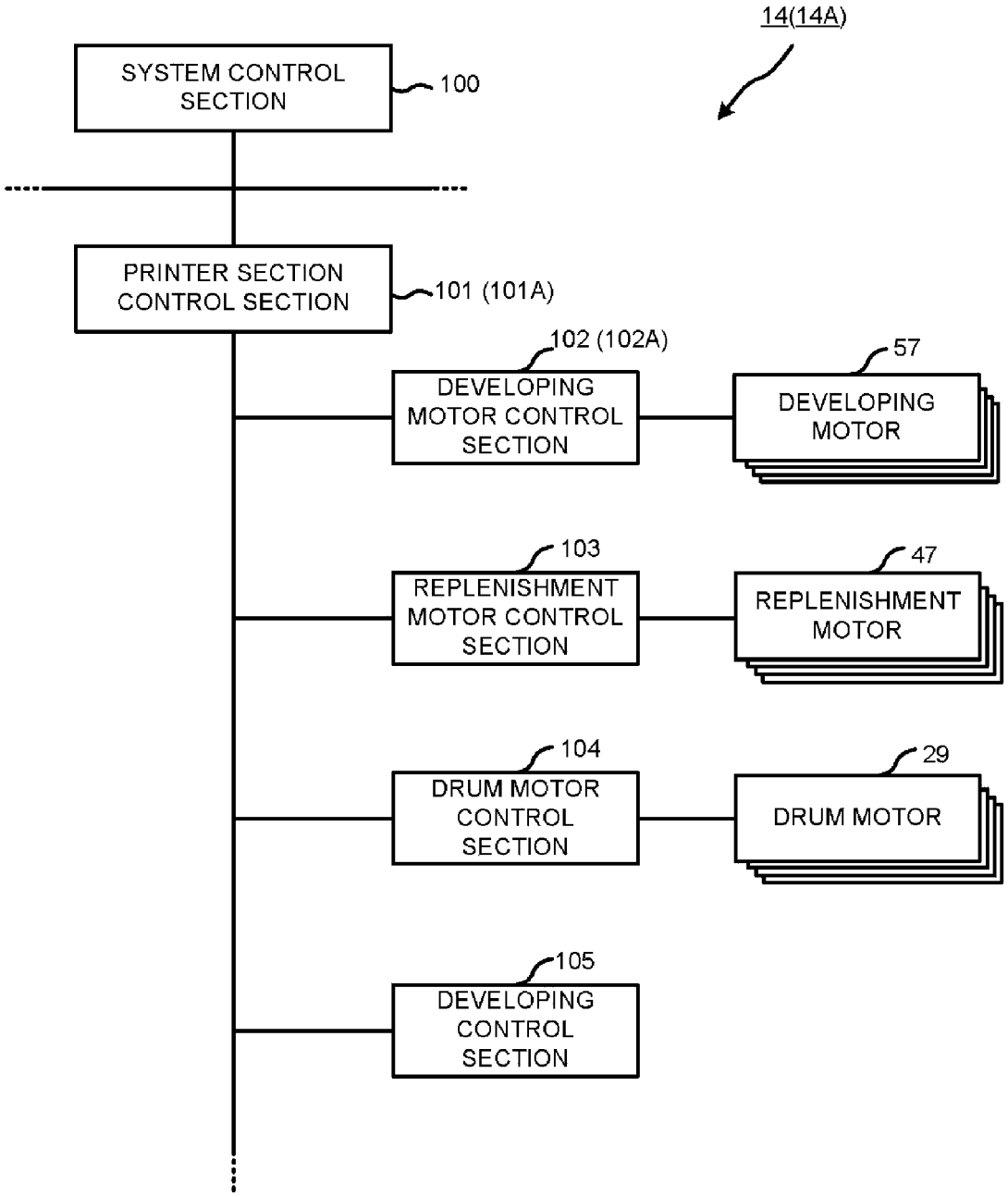
FIG. 7 is a block diagram illustrating an example of the constitution of the main portions of a control unit of the image forming apparatus according to the first embodiment.

As shown in FIG. 1, the image forming apparatus 10A is provided with a control unit 14A instead of the control unit 14 of the image forming apparatus 10 according to the first embodiment. As shown in FIG. 7, the control unit 14A includes a printer section control section 101A (device control section) instead of the printer section control section 101 of the control unit 14. The control unit 14A further includes a developing motor control section 102A (motor control section) instead of the developing motor control section 102 of the control unit 14.

As shown in FIG. 2, the image forming apparatus 10A is provided with a developing device 55 instead of the developing device 25 of the image forming apparatus 10 according to the first embodiment.

Hereinafter, the part different from the first embodiment is mainly described.

As shown in FIG. 4, the developing device 55 includes a developing agent storage section 64 instead of the developing agent storage section 34 of the developing device 25. The developing agent storage section 64 is provided with a discharge port 64*e* instead of the discharge port 34*e* of the first embodiment. The discharge port 64*e* is formed into such a height that the developing agent $D_Y$ ($D_M$, $D_C$, $D_K$) can be discharged through the discharge port 64*e* more easily than through the discharge port 34*e*.

In the present embodiment, the developing motor control section 102A can switch the rotation speed of the developing motor 57 between rotation speeds v1 and v2. The rotation speed v1 is equal to the rotation speed $V1_T$ in the first embodiment. The rotation speed v2 is equal to the rotation speed $V1_S$ in the first embodiment.

When the first mixer 35A and the second mixer 35B are rotated during the developing process, the developing agent $D_Y$ ($D_M$, $D_C$, $D_K$) is conveyed to a position nearby the discharge port 64*e*. In the present embodiment, in a case of forming an image on one sheet S with the rotation speed of the developing motor 57 controlled to the rotation speed v2, a certain amount of developing agent $D_Y$ ($D_M$, $D_C$, $D_K$) is discharged from the discharge port 64*e*. On the other hand, in a case of forming an image on one sheet S with the rotation speed of the developing motor 57 controlled to the rotation speed v1, the developing agent $D_Y$ ($D_M$, $D_C$, $D_K$) is not discharged from the discharge port 64*e*.

That is, the width of the groove part 34*b* at the first end part E1 and the height of the discharge port 64*e* are not great enough to cope with the conveyance amount of the developing agent $D_Y$ ($D_M$, $D_C$, $D_K$) conveyed when the rotation speed of the developing motor 57 is controlled to the rotation speed v2. The width of the groove part 34*b* at the first end part E1 and the height of the discharge port 64*e* are great enough to cope with the conveyance amount of the developing agent $D_Y$ ($D_M$, $D_C$, $D_K$) conveyed when the rotation speed of the developing motor 57 is, controlled to the rotation speed v1.

In the present embodiment, the rotation speed v1 of the developing motor 57 is a first speed at which the developing agent $D_Y$ ($D_M$, $D_C$, $D_K$) is not discharged from the discharge port 64*e*. The rotation speed v2 of the developing motor 57 is a second speed higher than the first speed at which the developing agent $D_Y$ ($D_M$, $D_C$, $D_K$) is discharged from the discharge port 64*e*.

In the present embodiment, the thick paper mode is a first developing mode in which the developing motor 57 is rotated at the first speed to carryout developing processing. The normal paper mode is a second developing mode in which the developing motor 57 is rotated at the second speed to carry out developing processing.

In the image forming apparatus 10 according to the first embodiment, the printer section control section 101 carries out a common control on the developing agent discharge operation in both the normal paper mode and the thick paper mode.

The printer section control section 101A of the image forming apparatus 10A according to the present embodiment carries out different controls on the developing agent discharge operations in the normal paper mode and the thick paper mode.

In the present embodiment, if a mode selection signal is input, similar to the first embodiment, the printer section control section 101A receives a notification indicating the normal paper mode or the thick paper mode. The printer section control section 101A carries out the same control as the first embodiment to the drum motor control section 104 according to the notified mode.

The printer section control section 101A controls the developing motor control section 102A to set the rotation speed v2 in the normal paper mode. The printer section control section 101A carries out developing operation of the normal paper mode. At this time, during the developing process and the non-developing process, the developing agent is discharged little by little along with the developing operation.

The printer section control section 101A controls the developing motor control section 102A to set the rotation speed v1 in the thick paper mode. The printer section control section 101A carries out developing operation of the thick paper mode. Further, if the developing operation of the thick paper mode for one sheet is completed, the printer section control section 101A controls the developing motor control section 102A to set the rotation speed v2 to carry out the developing agent discharge operation of the present embodiment.

Next, as to the operations of the image forming apparatus 10A, the operations relating to the developing agent discharge control method according to the present embodiment are mainly described.

Figure 11:
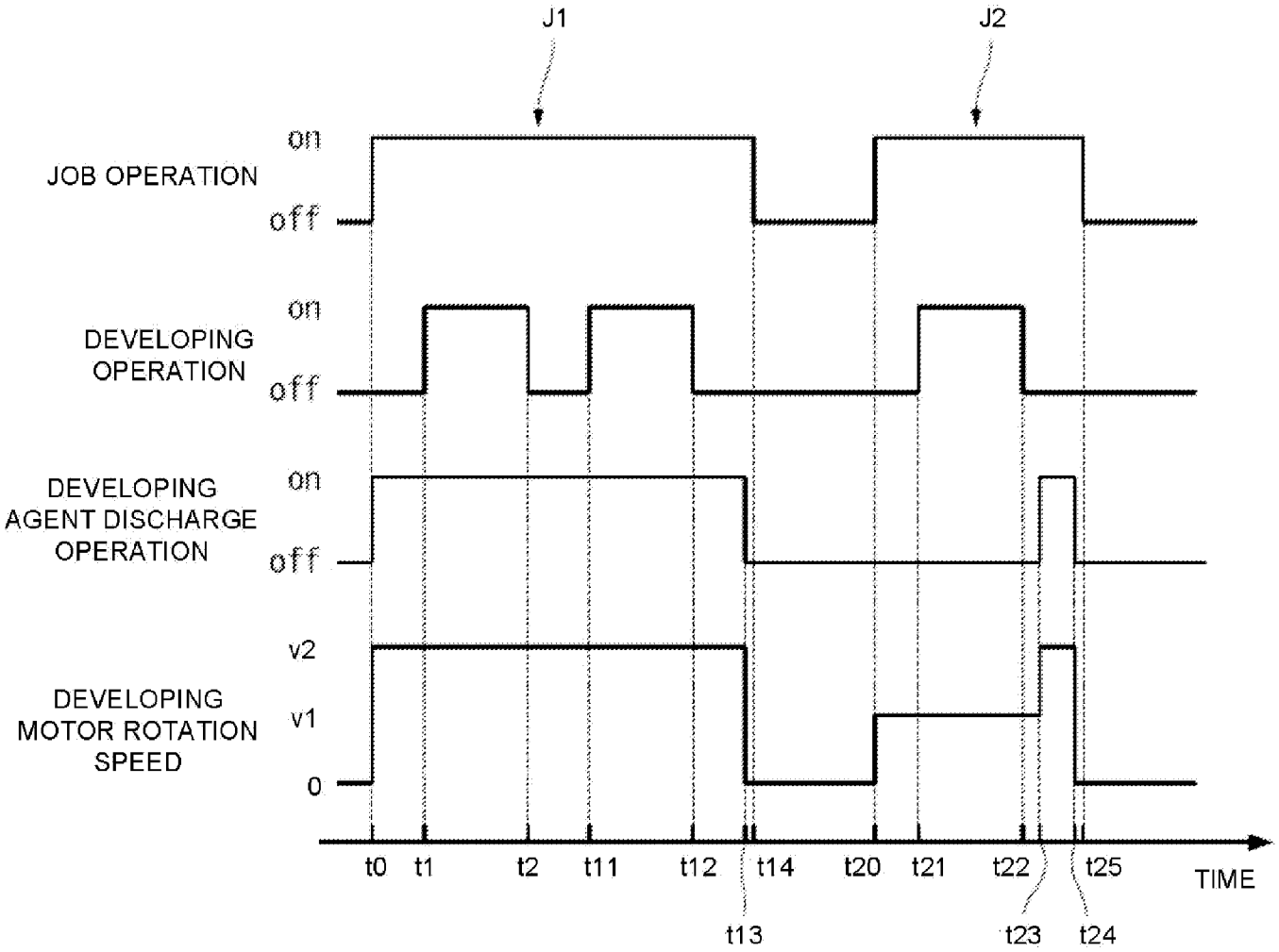
FIG. 11 is a timing chart illustrating an example of the operations of the image forming apparatus according to a second embodiment.

FIG. 11 is a timing chart illustrating an example of the operations of the image forming apparatus according to the second embodiment. As an example, a job J1 and a job J2 are carried out in sequence in the operation example shown in FIG. 11. The job J1 carries out image forming processing with the second developing mode on the sheet S including two normal paper of the same size. The job J2 carries out image forming processing with the first developing mode on the sheet S including one thick paper.

FIG. 11 shows the operations of each image forming section 15Y, 15M, 15C and 15K. Similar to the first embodiment described above, the operations are executed at timing with an appropriate time difference.

At time t0, the system control section 100 detects a job start signal of the job J1. The image forming apparatus 10A starts the image forming processing of the job J1. The image information is obtained by reading the copy object by the scanner section 12 and then sent to the printer section 11; alternatively, the image information is sent to the printer section 11 from the external device.

The printer section control section 101A sends a control signal to the control section of each device of the printer section 11 to enable each device to carry out the following operations.

The image forming sections 15Y, 15M, 15C and 15K carry out charging, exposure, developing and transfer processing based on the image information corresponding to each color to form toner images to be transferred to the sheet S including normal paper on the intermediate transfer belt 19.

The developing control section 105 carries out a control which is the same as that in the operation example of the first embodiment except that the number of sheets to be subjected to image formation is two and that the mode is limited to the normal paper mode. That is, the developing control section 105 carries out the control of the developing operation of the normal paper mode during the time t1~t2 and the t11~t12.

On the other hand, similar to the first embodiment, the developing motor control section 102A starts to rotate the developing motor 57 at the rotation speed v2 at the time t0. However, what is different from the first embodiment is that the developing motor control section 102A maintains the rotation speed of the developing motor 57 at the rotation speed v2 till the time t12. The time t12 is the timing when all the developing operations of the job J1 are completed.

In the operation example shown in FIG. 11, the developing motor 57 is maintained at the rotation speed v2 till the time t13. At the time t13, the developing motor control section 102A stops the rotation of the developing motor 57.

During the time t0~t13, the developing motor 57 is rotated at the rotation speed v2. Thus, the developing agent $D_Y$ ($D_M$, $D_C$, $D_K$) in the developing agent storage section 64 is moved to a position nearby the discharge port 64*e* by the first mixer 35A and the second mixer 35B. The developing agent $D_Y$ ($D_M$, $D_C$, $D_K$) stacked nearby the discharge port 64*e* sequentially reaches a height higher than the lower end part of the discharge port 64*e*. The developing agent $D_Y$ ($D_M$, $D_C$, $D_K$) is discharged to the developing agent reception section 34*f* from the discharge port 64*e* little by little.

The time t13 is a time when a certain amount of developing agent $D_Y$ ($D_M$, $D_C$, $D_K$) that needs to be discharged is discharged. However, if the certain amount of developing agent $D_Y$ ($D_M$, Dc, $D_K$) that needs to be discharged can be discharged at the time t12, the t12 may be set to be equivalent to the t13.

The system control section 100, if confirming that the operation of each device control section is completed after the time t13, terminates the image forming operation of the image forming apparatus 10A of the modification at time t14. In this way, the job J1 is completed.

In the job J1, the developing agent discharge operation is carried out even during the developing operations.

At time t20, the system control section 100 detects a job start signal of the job J2. The image forming apparatus 10A starts the image forming processing of the job J2.

The printer section control section 101A sends a control signal to the control section of each device of the printer section 11 to enable each device to carry out the following operations.

The image forming sections 15Y, 15M, 15C and 15K carry out charging, exposure, developing and transfer processing based on the image information corresponding to each color to form toner images to be transferred to the sheet S including thick paper on the intermediate transfer belt 19.

The developing control section 105 carries out a control which is the same as that in the job J1 except that the number of sheets to be subjected to image formation is one and that the mode is limited to the thick paper mode. That is, the developing control section 105 carries out the control of the developing operation of the thick paper mode during the time t21~t22.

On the other hand, similar to the first embodiment, the developing motor control section 102A starts to rotate the developing motor 57 at the rotation speed v1 at the time t20. The developing motor control section 102A maintains the rotation speed of the developing motor 57 at the rotation speed v1 till time t23 after the time t22 when the developing operation is completed.

When the developing motor 57 is rotated at the rotation speed v1, the developing agent $D_Y$ ($D_M$, $D_C$, $D_K$) is not discharged from the discharge port 64*e*. This is because when the rotation speed of the developing motor 57 is the rotation speed v1, the developing agent $D_Y$ ($D_M$, $D_C$, $D_K$) moved by the first mixer 35A and the second mixer 35B does not overflow from the discharge port 64*e*.

The developing motor control section 102A switches the rotation speed of the developing motor 57 to the rotation speed v2 at time t23. The amount of the developing agent $D_Y$ ($D_M$, $D_C$, $D_K$) moved to a position nearby the discharge port 64*e* is increased. If the stacking amount of the developing agent $D_Y$ ($D_M$, $D_C$, $D_K$) is greater than the height of the discharge port 64*e*, the developing agent $D_Y$ ($D_M$, $D_C$, $D_K$) is discharged to the developing agent reception section 34*f* through the discharge port 64*e*. Similar to the first embodiment, the developing agent $D_Y$ ($D_M$, $D_C$, $D_K$) discharged to the developing agent reception section 34*f* is discharged to the outside of the developing device 55.

The developing motor control section 102A stops the rotation of the developing motor 57 at time t24. Thus, the discharge of the developing agent $D_Y$ ($D_M$, $D_C$, $D_K$) is stopped at the time t24. The time t24 is set based on the time required to discharge a certain amount of developing agent $D_Y$ ($D_M$, $D_C$, $D_K$) that needs to be discharged.

In this way, during the time t23~t24, a certain amount of developing agent $D_Y$ ($D_M$, $D_C$, $D_K$) is discharged from the developing agent storage section 64.

The system control section 100, if confirming that the operation of each device control section is completed after the time t24, terminates the image forming operation of the image forming apparatus 10A at time t25. In this way, the job J2 is terminated.

In the job J2, similar to the first embodiment described above, the developing agent discharge operation is carried out after the developing operation and before the next developing operation. In the job J2, as one example, one sheet S is subjected to image forming processing. However, a plurality of sheets S may be subjected to image forming processing in the job J2. In this case, similar to the first embodiment described above, the image forming apparatus 10A can carry out the developing agent discharge operation every time one sheet S is subjected to image forming processing. Alternatively, similar to each modification of the first embodiment, the image forming apparatus 10A can carry out the developing agent discharge operation at appropriate timing except during the developing process.

When the first mixer 35A and the second mixer 35B are rotated at the rotation speed v1, the image forming apparatus 10A carries out the developing agent discharge operation in a way similar to the first embodiment. In this case, similar to the first embodiment described above, the constitution of the image forming apparatus 10A is simplified compared with the conventional technology. The degradation of the photoconductive drum 30 and the adhering of the toner to the photoconductive drum 30 can be prevented even if the developing roller 37 is rotated at a high speed higher than the developing linear velocity of the thick paper mode in the thick paper mode.

On the other hand, when the first mixer 35A and the second mixer 35B are rotated at the rotation speed v2, the image forming apparatus 10A carries out the developing agent discharge operation along with the developing operation.

Hereinafter, a modification of the first and the second embodiments is described.

In the image forming apparatuses 10 and 10A according to the first and the second embodiments described above, the developing motor 57 rotates the developing roller 37, the first mixer 35A and the second mixer 35B. However, the developing agent discharge operation may be carried out by switching only the rotation speed of a motor which drives the first mixer 35A and the second mixer 35B. Thus, the developing roller 37 and the first mixer 35A and the second mixer 35B may be respectively driven by different motors.

In this case, the developing speed during the developing process is not increased even if the motor for driving the first mixer 35A and the second mixer 35B is speeded up to the second speed. Thus, during the developing process, the developing roller 37 is always rotated at a rotation speed suitable for the developing linear velocity, which can stabilize the state of the developing agent during the developing process.

In accordance with at least one embodiment described above, the image forming apparatus is provided with a developing agent storage section in which a discharge port is formed, a developing agent mixer, and a motor for rotating the developing agent mixer. The image forming apparatus is further provided with a motor control section which rotates the motor at either a first speed or a second speed. The image forming apparatus is also provided with a device control section which controls the motor control section to switch the rotation speed of the motor to the second speed at the timing different from the timing when an electrostatic latent image is being developed. In this way, the developing roller and the developing agent mixer can be rotated by the same motor. The constitution of a two-component developing type image forming apparatus which discharges the developing agent little by little can be simplified.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a photoconductor on which an electrostatic latent image is formed;

a developing roller configured to supply developing agent containing toner to the surface of the photoconductor to develop the electrostatic latent image;

a developing agent storage section, which is provided with a discharge port for discharging the developing agent, configured to store the developing agent and supply the developing agent to the developing roller;

a developing agent mixer configured inside the developing agent storage section to stir the developing agent and move the developing agent towards the discharge port;

a motor configured to rotate the developing roller and the developing agent mixer;

a motor control section configured to rotate the motor at either a first speed at which the developing agent is not discharged from the discharge port or a second speed higher than the first speed to discharge the developing agent from the discharge port; and a device control section configured to control the motor control section to switch a rotation speed of the motor to the second speed at a first timing different from a second timing when the developing roller develops the electrostatic latent image, the device control section being configured to switch a linear velocity of the photoconductor to either a first linear velocity or a second linear velocity higher than the first linear velocity, the device control section being configured to execute a first developing mode in which the motor is rotated at the first speed to carry out developing processing in a case in which the linear velocity of the photoconductor is switched to the first linear velocity, the device control section being configured to execute a second developing mode in which the motor is rotated at the second speed to carry out developing processing in a case in which the linear velocity of the photoconductor is switched to the second linear velocity, the device control section being configured to control the motor control section to switch the rotation speed of the motor to the second speed at the first timing after the first developing mode is executed.

2. The image forming apparatus according to claim 1, wherein the device control section controls the motor control section to switch the rotation speed of the motor to the second speed only at the first timing.

3. The image forming apparatus according to claim 1, wherein the device control section controls the motor control section to switch the rotation speed of the motor to the second speed every time a developing operation in one job is completed.

4. The image forming apparatus according to claim 1, wherein the device control section controls the motor control section to switch the rotation speed of the motor to the second speed every time a developing operation of image forming processing on one sheet is completed.

5. The image forming apparatus according to claim 1, wherein the device control section predicts a discharge amount of the developing agent, and controls the motor control section to switch the rotation speed of the motor to the second speed at the first timing different from the second timing when the developing roller develops the electrostatic latent image in a case in which it is predicted that the discharge amount is insufficient.

6. A developing agent discharge control method comprising:

rotating a developing agent mixer arranged inside a developing agent storage section which stores developing agent containing toner at a first speed at which the developing agent is stirred in the developing agent storage section and is not discharged from a discharge port of the developing agent storage section;

supplying the developing agent to a developing roller through a rotation of the developing agent mixer at the first speed to develop an electrostatic latent image formed on a photoconductor wherein the developing roller and the developing agent mixer are rotated by the same motor;

rotating the developing agent mixer at a second speed at which the developing agent is stirred in the developing agent storage section and is discharged from the discharge port of the developing agent storage section at a first timing different from a second timing when the electrostatic latent image is developed;

discharging the developing agent from the discharge port through the rotation of the developing agent mixer at the second speed;

switching a linear velocity of the photoconductor to either a first linear velocity or a second linear velocity higher than the first linear velocity;

executing a first developing mode in which the motor is rotated at the first speed to carry out developing processing in a case in which the linear velocity of the photoconductor is switched to the first linear velocity;

executing a second developing mode in which the motor is rotated at the second speed to carry out developing processing in a case in which the linear velocity of the photoconductor is switched to the second linear velocity; and switching the rotation speed of the motor to the second speed at the first timing after the first developing mode is executed.

* * * * *